US008794783B1

(12) United States Patent
Nappi

(10) Patent No.: US 8,794,783 B1
(45) Date of Patent: Aug. 5, 2014

(54) SYSTEM FOR DISTINGUISHING A TARGET KEY FROM AT LEAST ONE OTHER KEY IN A DARK ENVIRONMENT AND METHOD OF USE

(76) Inventor: Michael Christopher Nappi, Coram, NY (US)

( * ) Notice: Subject to any disclaimer, the term of this patent is extended or adjusted under 35 U.S.C. 154(b) by 155 days.

(21) Appl. No.: 13/439,370

(22) Filed: Apr. 4, 2012

Related U.S. Application Data

(60) Provisional application No. 61/569,750, filed on Dec. 12, 2011.

(51) Int. Cl.
*E05B 17/10* (2006.01)

(52) U.S. Cl.
CPC ..... *E05B 17/10* (2013.01)
USPC ..... 362/109; 362/100; 362/116

(58) Field of Classification Search
USPC ..... 362/116, 253, 234, 184, 800
See application file for complete search history.

(56) References Cited

U.S. PATENT DOCUMENTS

| | | | | |
|---|---|---|---|---|
| 6,774,787 | B1 * | 8/2004 | Melbourne | 340/539.1 |
| 7,034,684 | B2 * | 4/2006 | Boman et al. | 340/568.1 |
| 7,453,357 | B2 * | 11/2008 | Bernal-Silva et al. | 340/539.32 |
| 7,800,492 | B2 * | 9/2010 | Olson | 340/539.1 |
| 8,253,559 | B2 * | 8/2012 | Howard et al. | 340/539.32 |
| 2012/0051072 | A1 * | 3/2012 | Yelverton et al. | 362/473 |

* cited by examiner

*Primary Examiner* — Elmito Breval
(74) *Attorney, Agent, or Firm* — Mary Frances Ludwig; Ted Masters

(57) ABSTRACT

A system for distinguishing a target key which opens a lock from at least one other connected key in a dark environment includes a magnet which is positioned adjacent to the lock, and which produces a magnetic field. The system further includes a light assembly which is connected to the target key. The light assembly includes a magnetically activated switch and a light source. When the light assembly is moved into the magnetic field of the magnet, the magnetically activated switch is activated and causes the light source to give off light, thereby distinguishing the target key from the at least one other key.

16 Claims, 8 Drawing Sheets

20
24
750
800
600
600
600
700
22
500

Fig. 17
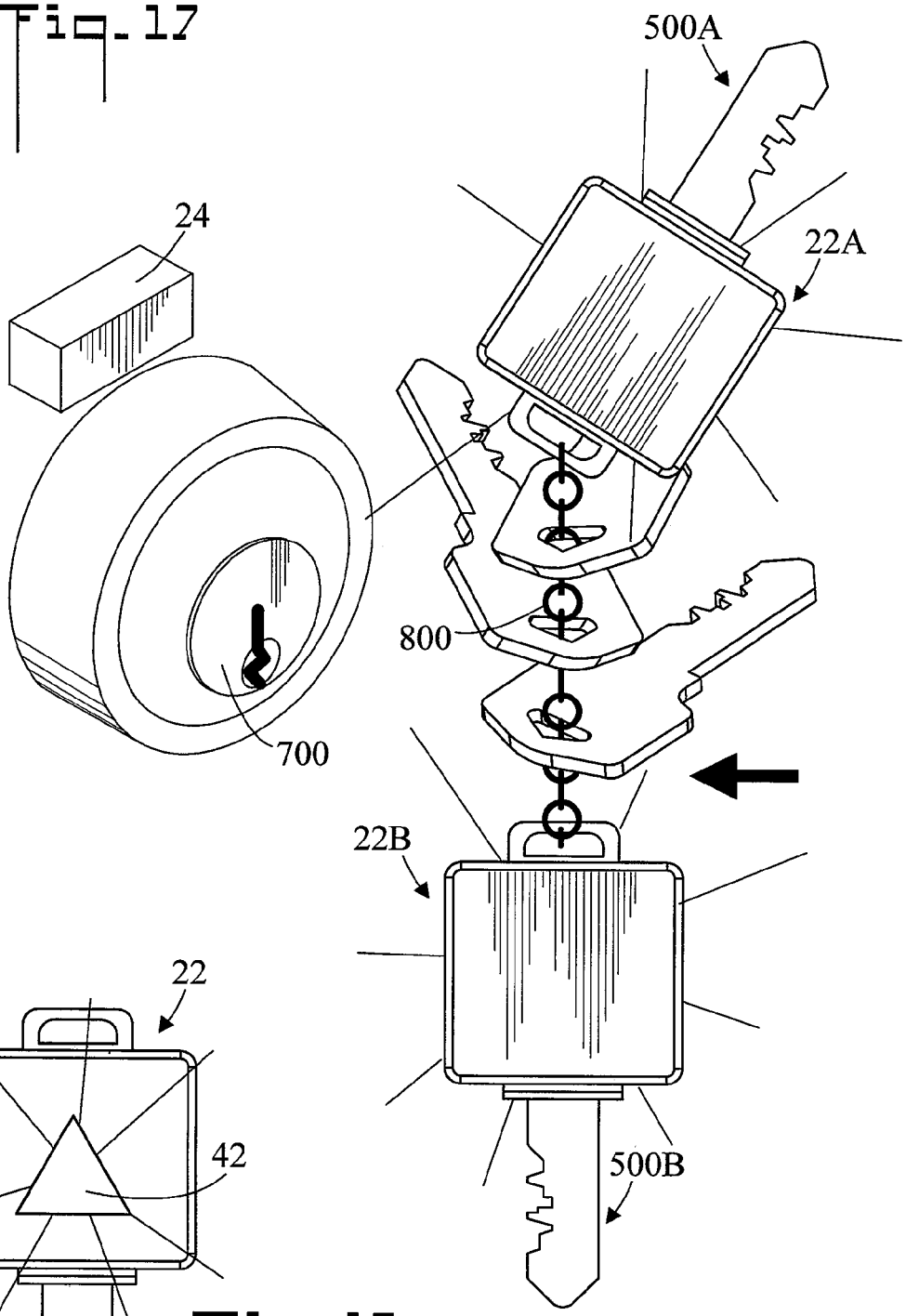
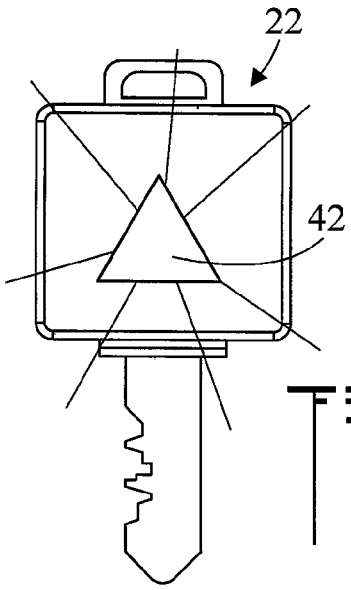
Fig. 18

SYSTEM FOR DISTINGUISHING A TARGET KEY FROM AT LEAST ONE OTHER KEY IN A DARK ENVIRONMENT AND METHOD OF USE

CROSS REFERENCE TO RELATED APPLICATION

This application claims the filing benefit under 35 U.S.C. §119(e) of U.S. Provisional Application No. 61/569,750, filed Dec. 12, 2011, which is hereby incorporated by reference.

TECHNICAL FIELD

The present invention pertains generally to keys for opening locks, and more particularly to a system for distinguishing a desired key from other keys in a dark environment.

BACKGROUND OF THE INVENTION

Keys, especially when a person must carry several, become hard to identify due to their similarity. Adding the element of darkness makes it difficult to identify the correct key to enter a house. Users who needed to find the proper key at their door can use a cellular phone's emitted light or a mini LED flashlight key chain in order to see which key to use. If that is not an option due to the phone not being handy, then users have to strain their eyes trying to stare at the set of keys on the key chain, struggling to identify the correct key.

BRIEF SUMMARY OF THE INVENTION

The present invention is directed to a system and method for identifying a particular key in a dark environment. The system includes a light assembly with is connected to the key, and which lights up when the key is moved next to the lock. The system eliminates the frustration of not being able to find the correct key, and expedites the entry process.

In accordance with an embodiment, a system for distinguishing a target key from at least one other key in a dark environment is provided. The target key is connected to the at least one other key (such as by a key chain), and the target key designed to open a lock such as on a front or back door of a house. The system includes a magnet which is positionable adjacent to the lock, the magnet producing a magnetic field. The system also includes a light assembly which is removably connectable to the target key. The light assembly includes a magnetically activated switch, and a light source which is electrically connected to the magnetically activated switch. When the magnet is positioned adjacent to the lock and the light assembly is connected to the target key, and the light assembly is moved into the magnetic field of the magnet, the magnetically activated switch activates and causes the light source to give off light, thereby distinguishing the target key from the at least one other key.

In accordance with another embodiment, the target key has a bow. The light assembly includes first and second shells which are shaped and dimensioned to enclose the bow of the target key.

In accordance with another embodiment, the first and second shells are translucent.

In accordance with another embodiment, at least one of the first shell and the second shell have translucent indicia, with the remainder of the first and second shells being opaque.

In accordance with another embodiment, the lock is connected to a door, the magnet is removably connectable to the door adjacent to the lock.

In accordance with another embodiment, the lock is surrounded by a lock housing, the magnet is disposed within the lock housing.

In accordance with another embodiment, a first light assembly is connected to the target key, the light source of the first light assembly giving off light of a first color. A second light assembly is connected to another key, the light source of the second light assembly giving off light of a second color, the second color being different from the first color.

In accordance with another embodiment, the light assembly is permanently attached to the key such as by a lock and key manufacturer.

Other embodiments, in addition to the embodiments enumerated above, will become apparent from the following detailed description, taken in conjunction with the accompanying drawings, which illustrate, by way of example, the principles of the system and method of use.

BRIEF DESCRIPTION OF THE DRAWINGS

FIG. 17 is a perspective view of two systems which give off different color light;

FIG. 18 is a front elevation view of a light assembly having translucent indicia;

DETAILED DESCRIPTION OF THE INVENTION

Figure 1:
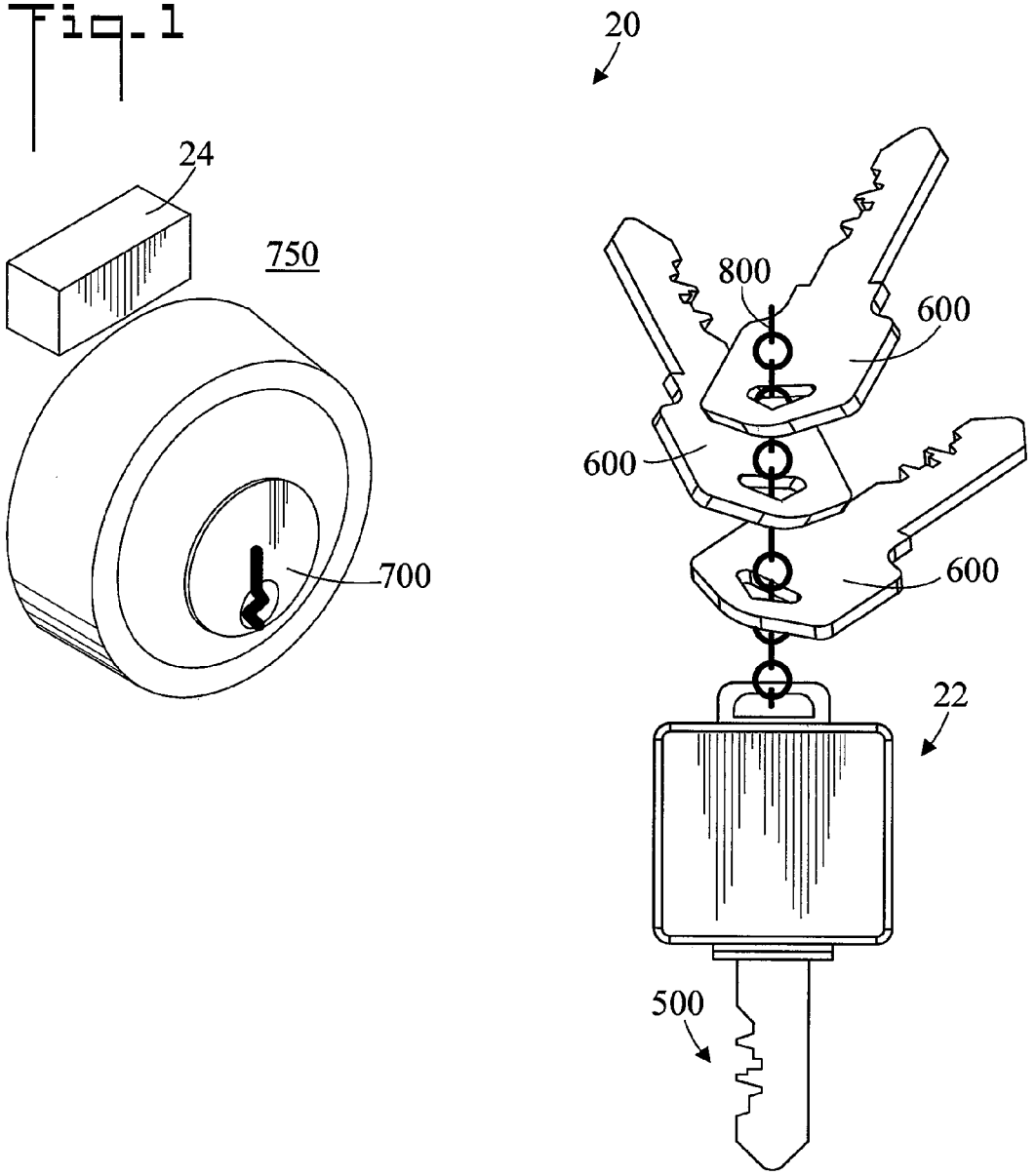
FIG. 1 is a perspective view of a system for distinguishing a target key from at least one other key in a dark environment.
Figure 2:
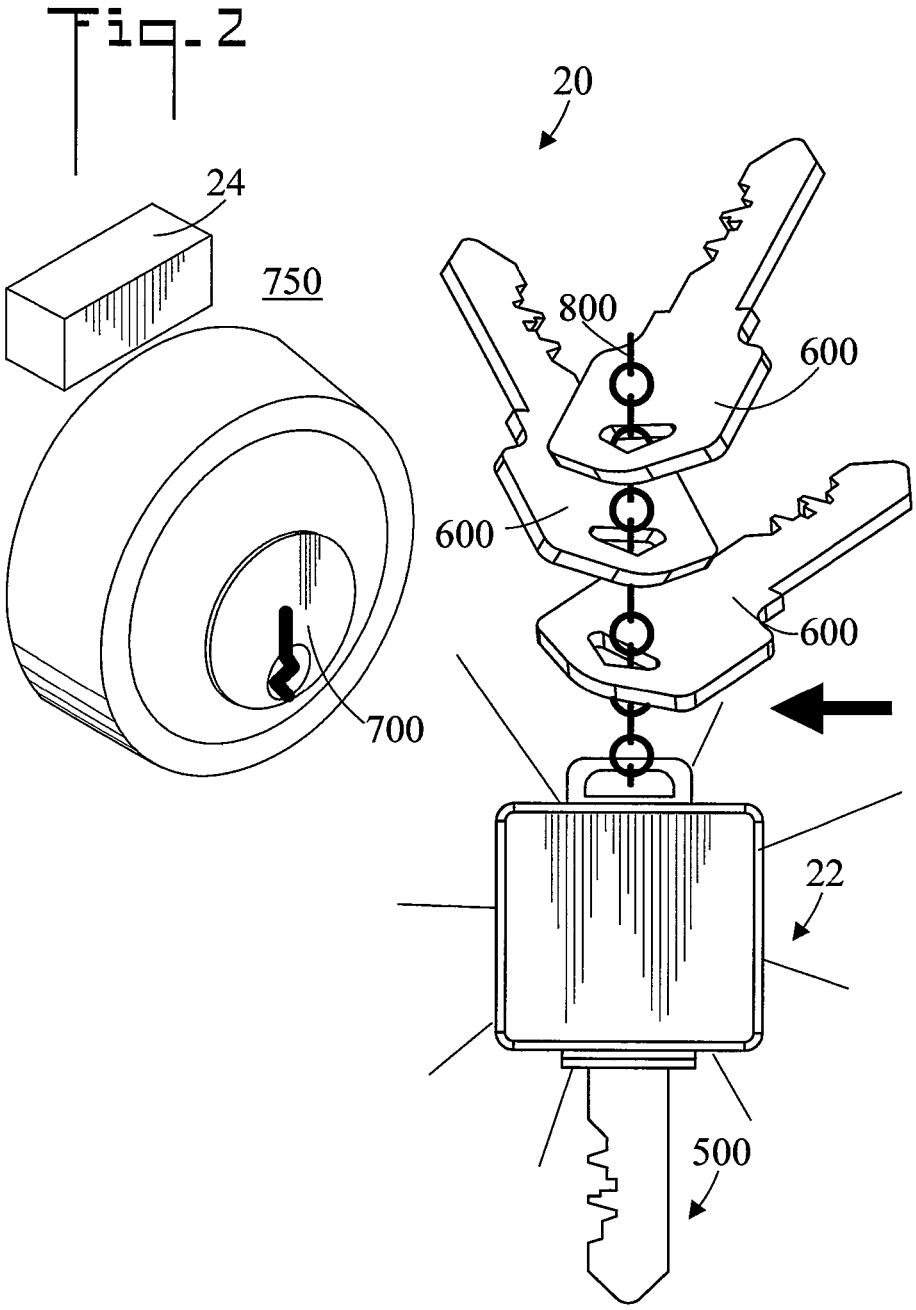
FIG. 2 is a perspective view of the system with the system giving off light.

Referring initially to FIGS. 1-2, there are illustrated perspective views of a system for distinguishing a target key 500 from at least one other key 600 in a dark environment, the system generally designated as 20. In FIG. 1 system 20 is de-energized, and in FIG. 2 system 20 is energized and gives off light. Target key 500 is designed to open (i.e. fits) a lock 700, which is typically connected to a door 750. Target key 500 is connected to at least one other key 600 (which does not open lock 700), such as with a key chain 800. System 20 further includes a magnet 24 which produces a magnetic field 25 (refer to FIGS. 13 and 14) and which is positionable adjacent to lock 700. In the shown embodiment, magnet 24 is removably connectable to door 750 adjacent to lock 700. The connection of magnet 24 can be effected by any convenient means such as with a peel-and-stick adhesive or by a screw fastener. Light assembly 22 of system 20 is removably connectable to target key 500, and includes a magnetically activated switch 26 (refer to FIG. 4), which is activated by magnetic field 25. Light assembly 22 also includes a light source 28 (refer to FIG. 4) which is electrically connected to magnetically activated switch 26. Electrically connected means that light source 28 is in series with magnetically activated switch 26. As shown in FIGS. 1 and 2, if magnet 24 is positioned adjacent to lock 700 and light assembly 22 is connected to target key 500, and light assembly 22 is moved into magnetic field 25 (refer to FIGS. 13 and 14) of magnet 24, magnetically activated switch 26 is activated and causes light source 28 to give off light, thereby distinguishing target key 500 from the at least one other key 600. In practice, this is accomplished by jiggling key chain 800 (including target key 500 and other keys 600) closely in front of lock 700.

Figure 3:
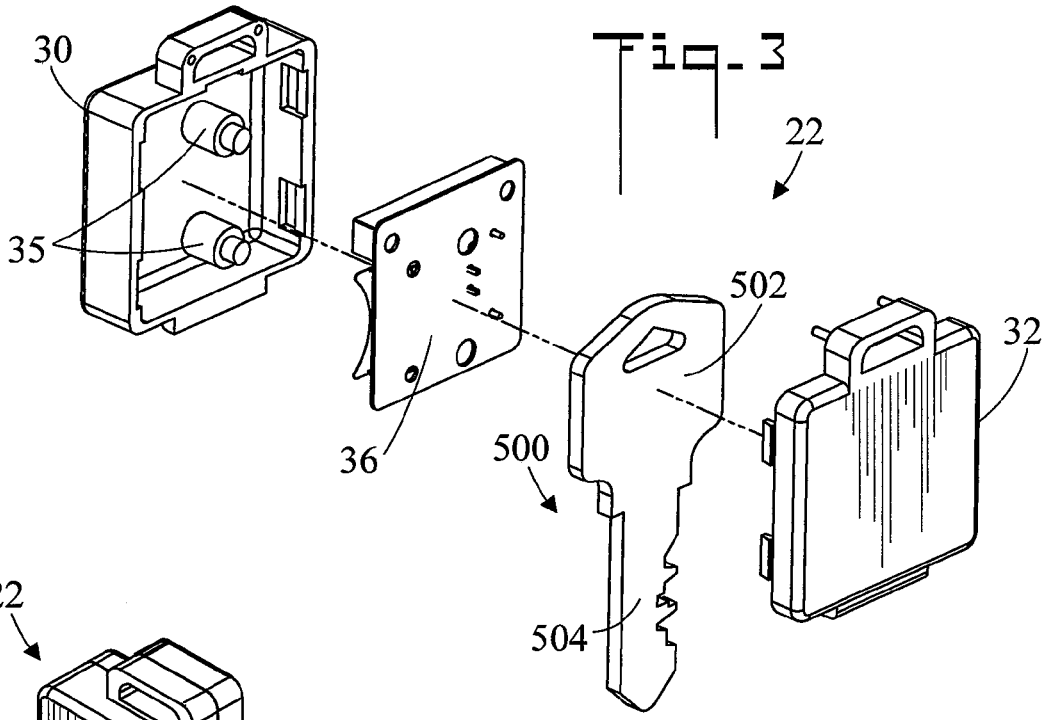
FIG. 3 is an exploded perspective view of a light assembly which is removably connectable to the target key.
Figure 5:
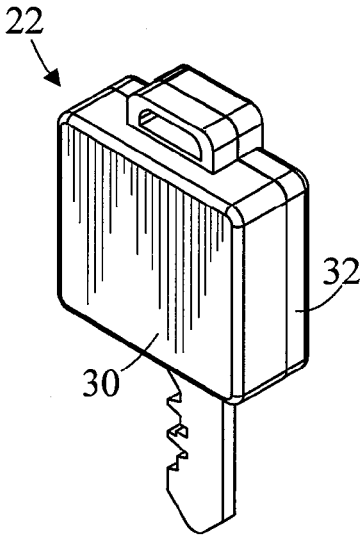
FIG. 5 is a perspective view of the light assembly connected to the target key.
Figure 4:
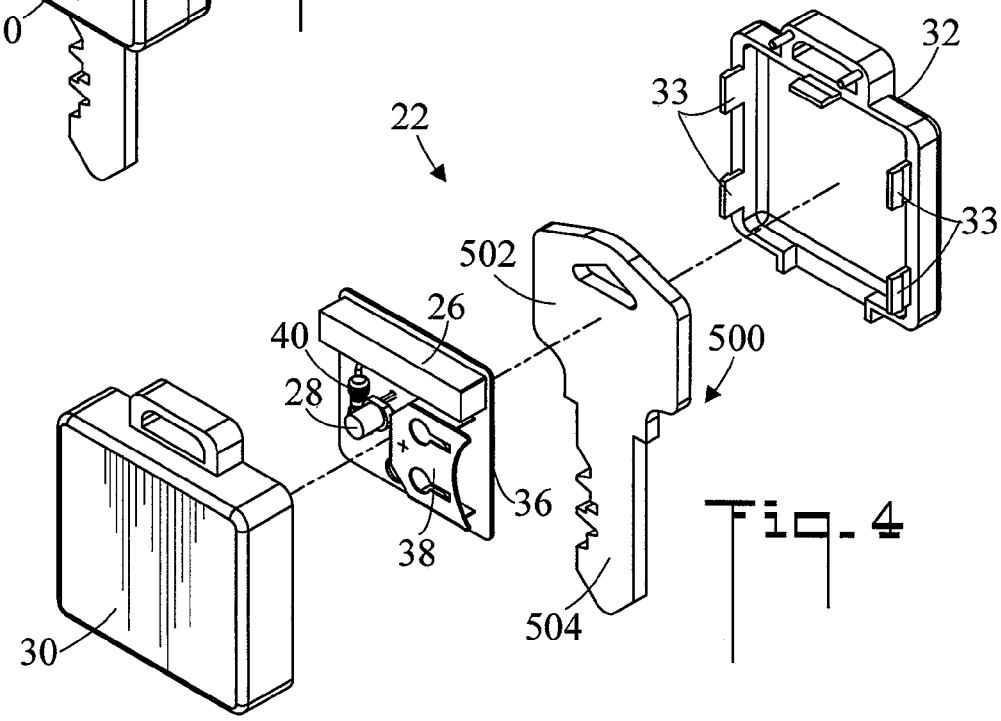
FIG. 4 is a reverse exploded perspective view of the light assembly and the target key.
Figure 7:
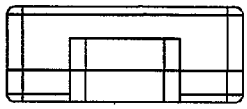
FIG. 7 is a top plan view of the light assembly connected to the target key.
Figure 9:
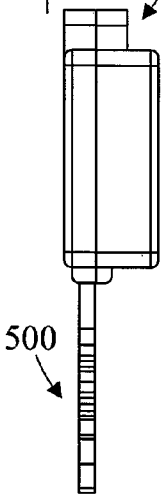
FIG. 9 is a side elevation view of the light assembly connected to the target key.
Figure 6:
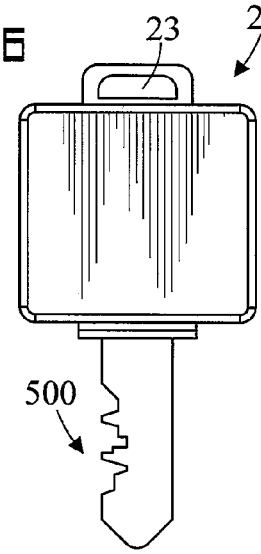
FIG. 6 is a front elevation view of the light assembly connected to the target key.
Figure 10:
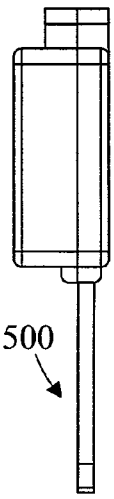
FIG. 10 is an opposite side elevation view of the light assembly connected to the target key.
Figure 8:
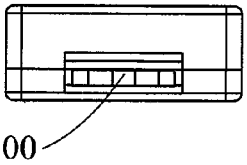
FIG. 8 is a bottom plan view of the light assembly connected to the target key.

FIGS. 3-4 are exploded perspective and reverse exploded perspective view respectively of a light assembly 22 which is removably connectable to target key 500, and FIG. 5 is a perspective view of light assembly 22 connected to target key 500. Target key 500 has a bow 502 (the part of the key which is turned by the user), and a blade 504. In the shown embodiment, light assembly 22 includes first 30 and second 32 shells which are shaped and dimensioned to enclose bow 502 of target key 500. In an embodiment, first 30 and second 32 shells are translucent (e.g. frosted), so that when light source 28 turns on, first 30 and second 32 shells glow. Also in the shown embodiment, first 30 and second 32 shells snap together around target key 500 with snaps 33. Shells 30 and 32 can be fabricated from a hard polymer or rubber. In another embodiment, light assembly 22 could slip rather than snap onto target key 500. In another embodiment, light assembly 22 is not removably connected to target key 500 by the user, but is rather permanently connected to target key 500 by the key manufacturer.

FIG. 4 shows magnetically activated switch 26 and light source 28 connected to a printed circuit board (PCB) 36. Also referring to FIGS. 13 and 14, in an embodiment magnetically activated switch 26 is a sensor such as a reed switch which is normally open, but closes when exposed to a magnetic field. Also in an embodiment, light source 28 is a light emitting diode (LED). PCB 36 further includes a battery holder 38 which holds a battery, and a current limiting resistor 40. FIG. 5 shows first 30 and second 32 shells snapped together to enclose target key 500 and PCB 36.

FIGS. 6-10 are front elevation view, top plan, bottom plan, side elevation, and opposite side elevation views respectively of light assembly 22 connected to target key 500. Light assembly 22 includes a passage 23 which accommodates key chain 800 (refer to FIGS. 1 and 2).

Figure 11:
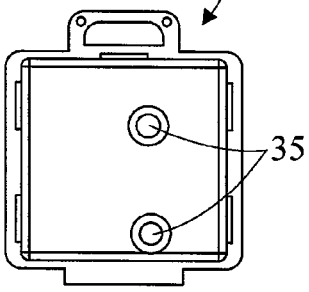
FIG. 11 is a front elevation view of a first shell.
Figure 12:
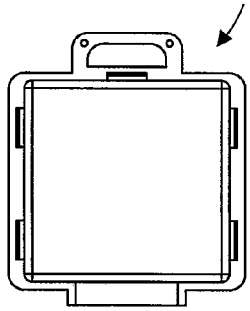
FIG. 12 is a front elevation view of a second shell.

FIG. 11 is a front elevation view of first shell 30, and FIG. 12 is a front elevation view of second shell 32. First shell 30 includes two alignment posts 35 which accept PCB 36 (refer to FIG. 3). It may be appreciated that first 30 and second 32 shells can be shaped and dimensioned to accommodate various key styles, shapes, and sizes.

Figure 13:
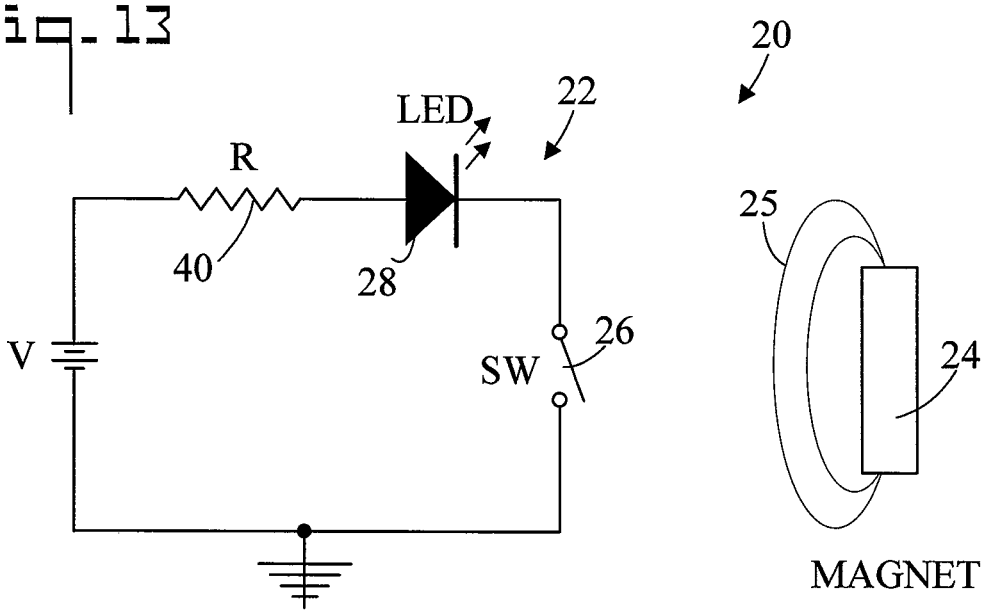
FIG. 13 is a circuit diagram of the system in a de-energized state.
Figure 14:
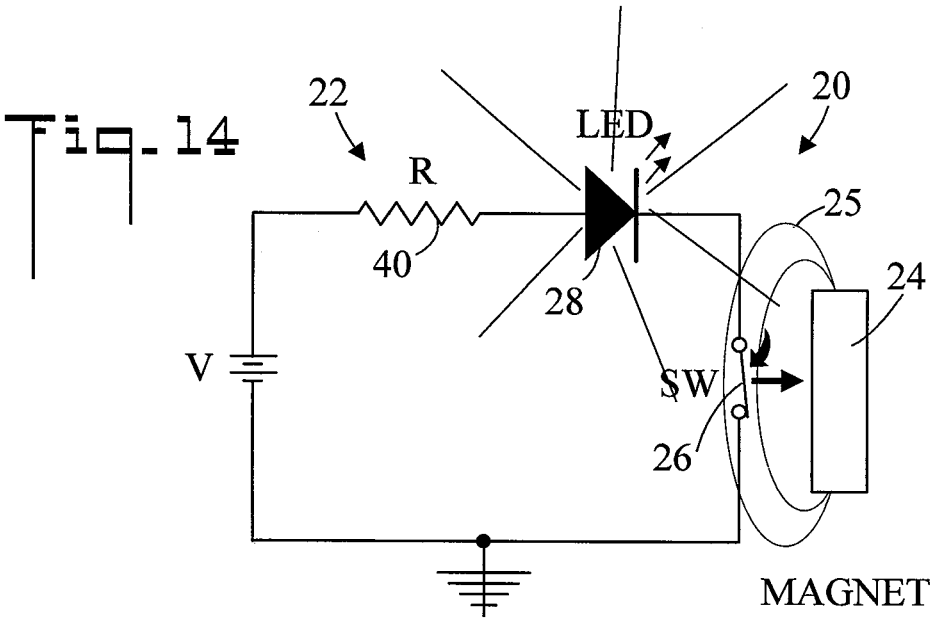
FIG. 14 is a circuit diagram of the system in an energized state.

FIG. 13 is a circuit diagram of system 20 in a de-energized state, and FIG. 14 is a circuit diagram of system 20 in an energized state. In FIG. 13, light assembly 22 is positioned far away from magnet 24 and magnetic field 25 as in FIG. 1, so that magnetically activated switch 26 is in the normally open position. In FIG. 14, light assembly 22 is moved toward magnet 24 so that magnetic field 25 causes magnetically activated switch 26 to activate (close) and current to flow through light source 28 so that light source 28 gives off light. Light source 28 will continue to give off light as long as magnetically activated switch 26 is activated by magnetic field 25. When light assembly 22 is removed from the proximity of magnet 24, magnetically activated switch 26 will open and light source 28 will cease to give off light. In an embodiment, the circuit is powered by a 3 VDC battery V, light source 28 is a 1.8V LED operating at a current of 20 mA, and current limiting resistor R is 68 ohms. It may be appreciated however, that other component values could also be utilized to produce the same result.

Figure 15:
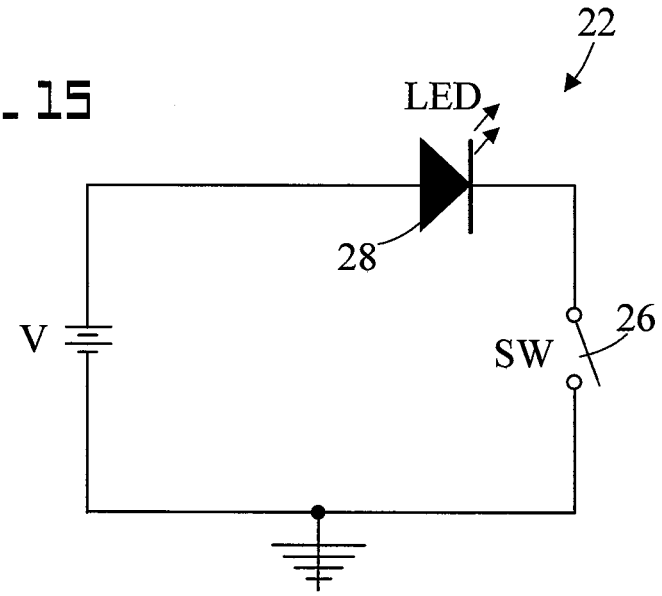
FIG. 15 is a circuit diagram of a second circuit embodiment.

FIG. 15 is a circuit diagram of a second circuit embodiment. In this embodiment, the battery V, light source 28 and magnetically activated switch 26 have been selected so that no current limiting resistor is required.

Figure 16:
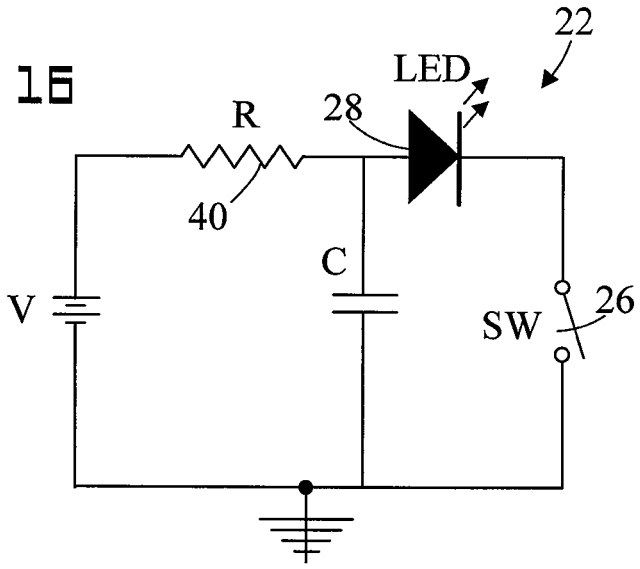
FIG. 16 is a circuit diagram of a third circuit embodiment.

FIG. 16 is a circuit diagram of a third circuit embodiment. In this embodiment a capacitor C is provided. By including capacitor C, light source 28 will remain on for a short period after light assembly 22 is removed from magnetic field 25 (refer to FIGS. 13 and 14).

FIG. 17 is a perspective view of two systems 20 which give off different color light. The two systems are first light assembly 22A and magnet 24, and second light assembly 22B and magnet 24. As such, when key chain 800 containing both light assembly 22A and 22*b* are brought close to magnet 24, both assemblies will light up. First light assembly 22A, is connected to a target key 500A (which opens lock 700), wherein light source 28 of first light assembly 22A gives off light of a first color. Conversely, second light assembly 22B is connected to another key 500B (which does not open lock 700), wherein light source 28 of second light assembly 22B gives off light of a second color which is different from the first color. For example, the light given off by first light assembly 22A might be red, and the light given off by second light assembly 22B might be blue. The user knows that first light assembly 22A is attached to target key 500A, and as such that key (the red glowing key) will open lock 700. In this fashion multiple keys for different doors can be identified.

FIG. 18 is a front elevation view of light assembly 22 having translucent indicia 42. In this embodiment, at least one of first shell 30 and second shell 32 have translucent indicia, with the remainder of first 30 and second 32 shells being opaque. As such, when light source 28 turns on, the light emanates from the indicia 42 only and not from the remaining surfaces of light assembly 22. Indicia 42 can include a symbol such as the shown triangle, or can include writing such as the name of a corporation or sports team.

Figure 19:
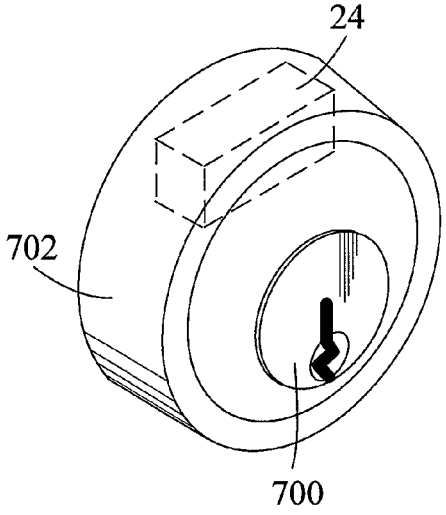
FIG. 19 is a perspective view of the system and a lock having an integral magnet; and, FIG. 20 is a perspective view of the system illuminating the lock.

FIG. 19 is a perspective view of the system and a lock 700 having an integral magnet 24. In this embodiment rather than being externally removably positioned adjacent lock 700 as in FIGS. 1 and 2, lock 700 has a housing 702 which surrounds the lock mechanism. Magnet 24 is disposed within lock housing 702, such as being placed there ("bundled") by the lock manufacturer. Similarly, light assembly 22 could be permanently connected (except for the battery) to target key 500 by the lock manufacturer, so that all system 20 components are an integral part of the purchased lock and key set (as opposed to the retrofit configuration of FIGS. 1-5).

Figure 20:
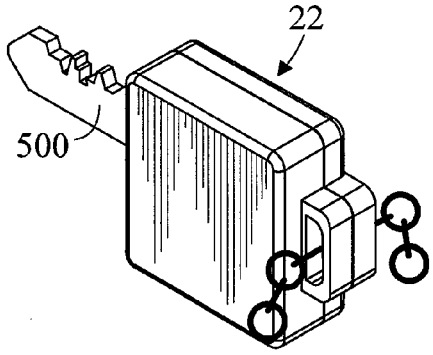
Figure 20:
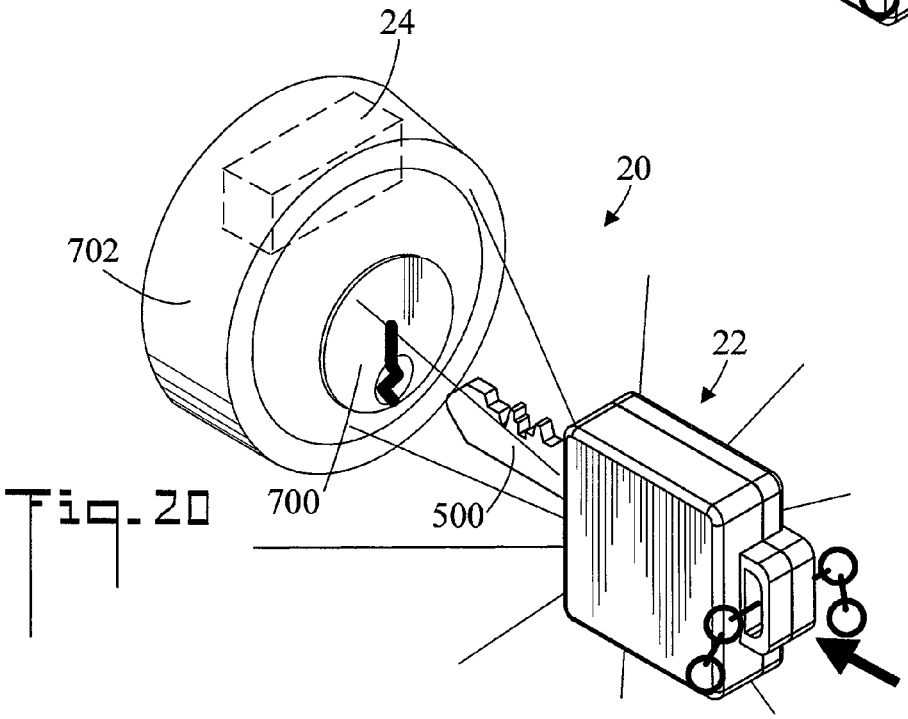

FIG. 20 is a perspective view of system 20 illuminating lock 700. In addition to lighting up to distinguish target key 500, light from light assembly 22 illuminates lock 700 to facilitate the insertion of target key 500 therein.

In terms of use, a method for distinguishing a target key 500 from at least one other key 600 in a dark environment includes: (refer to FIGS. 1-20)

(a) providing a lock 700 located in a dark environment;

(b) providing a target key 500 which is designed to open lock 700, target key 500 connected to at least one other key 600;

(c) providing a system 20 for distinguishing target key 500 from the at least one other key 600, system 20 including:

a magnet 24 which is positionable adjacent to lock 700, magnet 24 producing a magnetic field 25;

a light assembly 22 which is removably connectable to target key 500, light assembly 22 including;

a magnetically activated switch 26; and, a light source 28 electrically connected to magnetically activated switch 26;

(d) positioning magnet 24 adjacent to lock 700;

(e) connecting light assembly 22 to target key 500;

(f) moving light assembly 22 into magnetic field 25 of magnet 24 causing magnetically activated switch 26 to activate which in turn causes light source 28 to give off light, thereby distinguishing target key 500 from the at least one other key 600.

The method further including:

in (b), target key 500 having a bow 502, in (c), light assembly 22 including first 30 and second 32 shells which are shaped and dimensioned to enclose bow 502 of target key 500; and, in (e), enclosing bow 502 of target key 500 in first 30 and second 30 shells.

The method further including:

in (c), first 30 and second 32 shells being translucent, so that in (f) first 30 and second 32 shells glow.

The method further including:

in (c), at least one first shell 30 and second shell 32 having translucent indicia 42, with the remainder of first 30 and second 32 shells being opaque; and, in (f), light emanating from the translucent indicia 42.

The method further including:

in (a), lock 700 surrounded by a lock housing 702; and, in (d), magnet 24 positioned within lock housing 702.

The method further including:

in (e), a first light assembly 22A connected to target key 500A, the light source 28 of first light assembly 22A giving off light of a first color;

a second light assembly 22B connected to another key 500B, the light source 28 of second light assembly 22B giving off light of a second color, the second color being different from the first color; and, in (f), the first color distinguishing target key 500A from the at least one other key 500B.

The method further including:

in (b), the target key 500 connected to the at least one other key 600 by a key chain 800; and, in (f), jiggling key chain 800 closely in front of lock 700.

The method further including:

after (f), using light from light assembly 22 to illuminate lock 700.

The embodiments of the system and method of use described herein are exemplary and numerous modifications, combinations, variations, and rearrangements can be readily envisioned to achieve an equivalent result, all of which are intended to be embraced within the scope of the appended claims. Further, nothing in the above-provided discussions of the system and method should be construed as limiting the invention to a particular embodiment or combination of embodiments. The scope of the invention is defined by the appended claims.

I claim:

1. A system for distinguishing a target key from at least one other key in a dark environment, the target key connected to the at least one other key, the target key designed to open a lock, the system comprising:

a magnet which is positionable adjacent to the lock, said magnet producing a magnetic field;

a light assembly which is removably connectable to the target key, said light assembly including;

a magnetically activated switch;

a light source electrically connected to said magnetically activated switch; and, if said magnet is positioned adjacent to the lock and said light assembly is connected to the target key, and said light assembly is moved into said magnetic field of said magnet, said magnetically activated switch is activated and causes said light source to give off light, thereby distinguishing the target key from the at least one other key.

2. The system according to claim 1, the target key having a bow, the system further including:

said light assembly including first and second shells which are shaped and dimensioned to enclose the bow of the target key.

3. The system according to claim 1, the lock connected to a door, the system further including:

said magnet removably connectable to the door.

4. The system according to claim 1, the lock surrounded by a lock housing, the system further including:

said magnet disposed within said lock housing.

5. The system according to claim 1, the system further including:

a first light assembly connected to the target key, said light source of said first light assembly giving off light of a first color; and, a second light assembly connected to another key, said light source of said second light assembly giving off light of a second color, said second color being different from said first color.

6. The system according to claim 1, the target key having a bow, the lock connected to a door, the system further including:

said light assembly including first and second shells which are shaped and dimensioned to enclose the bow of the target key; and, said magnet removably connectable to the door.

7. A method for distinguishing a target key from at least one other key in a dark environment, comprising:

(a) providing a lock located in a dark environment;

(b) providing a target key which is designed to open said lock, said target key connected to at least one other key;

(c) providing a system for distinguishing said target key from said at least one other key, said system including:

a magnet which is positionable adjacent to said lock, said magnet producing a magnetic field;

a light assembly which is removably connectable to said target key, said light assembly including;

a magnetically activated switch; and, a light source electrically connected to said magnetically activated switch;

(d) positioning said magnet adjacent to said lock;

(e) connecting said light assembly to said target key; and, (f) moving said light assembly into said magnetic field of said magnet causing said magnetically activated switch to activate which in turn causes said light source to give off light, thereby distinguishing said target key from said at least one other key.

8. The method of claim 7, further including:

in (b), said target key having a bow, in (c), said light assembly including first and second shells which are shaped and dimensioned to enclose said bow of said target key; and, in (e), enclosing said bow of said target key in said first and second shells.

9. The method of claim 7, further including:

in (a), said lock surrounded by a lock housing; and, in (d), said magnet positioned within said lock housing.

10. The method of claim 7, further including:

in (e), a first light assembly connected to said target key, said light source of said first light assembly giving off light of a first color;

a second light assembly connected to another key, said light source of said second light assembly giving off light of a second color, said second color being different from said first color; and, in (f), said first color distinguishing said target key from said at least one other key.

11. The method of claim 7, further including:

in (b), said target key connected to said at least one other key by a key chain; and, in (f), jiggling said key chain closely in front of said lock.

12. The method of claim 7, further including:

after (f), using said light from said light assembly to illuminate said lock.

13. A system for distinguishing a target key from at least one other key in a dark environment, the target key connected to the at least one other key, the target key designed to open a lock, the system comprising:

a magnet which is positionable adjacent to the lock, said magnet producing a magnetic field;

a light assembly which is connected to the target key, said light assembly including;

a magnetically activated switch;

a light source electrically connected to said magnetically activated switch; and, if said magnet is positioned adjacent to the lock and said light assembly is moved into said magnetic field of said magnet, said magnetically activated switch is activated and causes said light source to give off light, thereby distinguishing the target key from the at least one other key.

14. The system according to claim 13, the lock connected to a door, the system further including:

said magnet removably connectable to the door.

15. The system according to claim 13, the lock surrounded by a lock housing, the system further including:

said magnet disposed within said lock housing.

16. The system according to claim 13, the system further including:

a first light assembly connected to the target key, said light source of said first light assembly giving off light of a first color; and, a second light assembly connected to another key, said light source of said second light assembly giving off light of a second color, said second color being different from said first color.

* * * * *